United States Patent [19]

Saperstein

[11] 4,256,177

[45] Mar. 17, 1981

[54] HEAT EXCHANGER

[75] Inventor: Zalman P. Saperstein, Racine, Wis.

[73] Assignee: Modine Manufacturing Company, Racine, Wis.

[21] Appl. No.: 959,350

[22] Filed: Nov. 9, 1978

[51] Int. Cl.[3] ..... F28D 1/04

[52] U.S. Cl. ..... 165/151

[58] Field of Search ..... 165/151, 152, 181, 182

[56] References Cited

U.S. PATENT DOCUMENTS

| | | | |
|---|---|---|---|
| 1,377,912 | 5/1921 | Nebel | 165/151 |
| 1,602,811 | 10/1926 | Clingaman | 165/151 |
| 1,646,384 | 10/1927 | Bergstrom . | |
| 1,935,332 | 11/1933 | Quarnstrom | 165/151 |
| 1,937,343 | 11/1933 | Higgins | 165/151 X |
| 2,537,984 | 1/1951 | Frisch | 165/182 |
| 3,191,418 | 6/1965 | Modine | 165/151 X |

*Primary Examiner*—Donald F. Norton

*Attorney, Agent, or Firm*—Wegner, Stellman, McCord, Wiles & Wood

[57] ABSTRACT

A heat exchanger of the fin and tube type where the tubes are spaced apart with confronting surfaces that are provided with a plurality of heat exchange fins attached to these confronting surfaces in sets of fins on each tube in which the sets of fins have portions such as the peaks of undulating fins adjacent to but spaced from each other to permit flow of a heat exchange second fluid over the fins and between the spaced portions for substantially unrestricted flow of the second fluid over the fins and through the resulting fin space, thereby providing substantially unrestricted flow of the second fluid with improved heat transfer.

One of the features of this invention is to provide an improved heat exchanger comprising a plurality of spaced tubes for a first heat exchange fluid and fins attached by metallurgical bonds to the outer surfaces of the tubes and extending toward adjacent fins but spaced therefrom to provide substantially free flow of a second fluid over and between the fins.

The most pertinent prior art of which applicant is aware are U.S. Pat. Nos. 1,521,880; 1,646,384; 1,893,270; 1,910,486; 2,012,269 and 3,537,516. None of these, however, disclose the invention disclosed and claimed herein.

6 Claims, 2 Drawing Figures

HEAT EXCHANGER

One of the features of this invention is to provide an improved heat exchanger comprising a plurality of spaced tubes for a first heat exchange fluid and fins attached by metallurgical bonds to the outer surfaces of the tubes and extending toward adjacent fins but spaced therefrom to provide substantially free flow of a second fluid over and between the fins.

The most pertinent prior art of which applicant is aware are U.S. Pat. Nos. 1,521,880; 1,646,384; 1,893,270; 1,910,486; 2,012,269 and 3,537,516. None of these, however, disclose the invention disclosed and claimed herein.

DESCRIPTION OF THE PREFERRED EMBODIMENT

Figure 2:
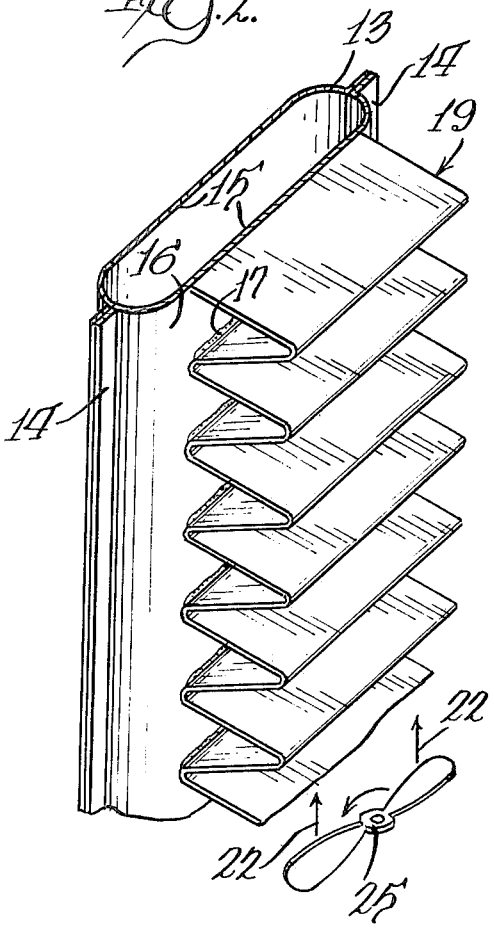
FIG. 2 is a fragmentary perspective view of a section of tube and an undulating fin metallurgically attached to an outer surface of the tube according to the present invention.
Figure 1:
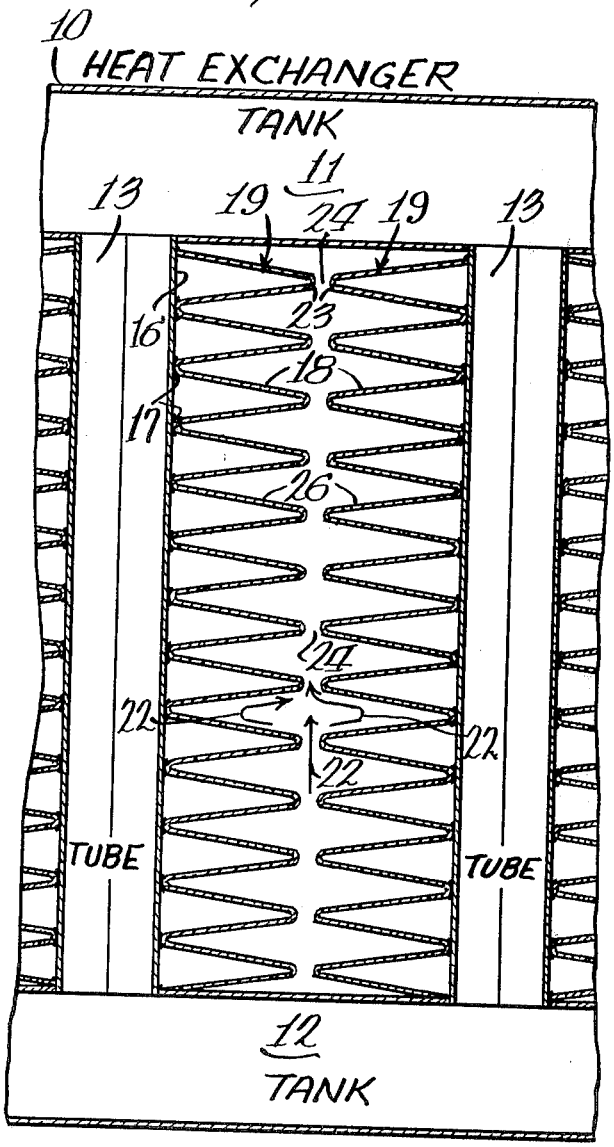
FIG. 1 is a fragmentary vertical sectional view through a tube and fin heat exchanger embodying the invention.

In the illustrated embodiment the heat exchanger 10 comprises an upper tank 11 and a lower tank 12 spaced therefrom with the tanks being interconnected by spaced parallel tubes 13 for flow of a first heat exchange fluid such as water or other liquid coolant between the tanks 11 and 12, and through the tubes 13.

The tubes 13 as illustrated in FIG. 2 are of generally oval cross section with edge seams 14 that may be brazed, soldered, welded or the like. Each tube has spaced substantially parallel sides 15 providing outer surfaces 16. Attached to these outer surfaces 16 by a metallurgical bond, which may be by brazing, soldering or the like for better heat transfer, are fins 18 in sets 19 with adjacent sets spaced from each other at adjacent portions to permit flow of a second heat exchange fluid 22 such as air over the surfaces of the fins 18 between the fins in substantially unrestricted flow, therefore improving the heat transfer.

In the embodiment illustrated the fins 18 are essentially continuously V-shaped in cross section with the fins of the two sets each having a plurality of linearly successive apexes 23 adjacent to but spaced from corresponding apexes of the other set to provide spaces 24 for the second fluid 22 circulation.

The metallurgical bond 17 uniting the fins 18 to the tubes 13 not only provides a strong structure but also aids the heat transfer between the tubes 13 and the fins 18 and thereby between the fins 18 and the second heat exchange fluid 22.

The second fluid, or air, 22 is forced over and between the sets 19 of fins 18 as by a blower illustrated schematically at 25 in FIG. 2. This forced fluid (air) flow means 25 thereby drives the second fluid 22 through the spaces 24. Because of the narrow space 24 the back pressure on the flowing fluid (air) 22 forces more intimate contact between the fluid 22 and the surfaces 26 of the fins, thereby improving heat transfer with the fluid 22.

Having described my invention as related to the embodiment shown in the accompanying drawings, it is my intention that the invention be not limited by any of the details of description, unless otherwise specified, but rather by construed broadly within its spirit and scope as set out in the appended claims.

I claim:

1. A heat exchanger, comprising: a plurality of spaced tubes; means for directing a first heat exchange fluid through said tubes, an adjacent pair of said tubes having spaced confronting surfaces; a plurality of heat exchange fins in spaced sets attached to said confronting surfaces of said tubes, said sets of fins having portions adjacent to but spaced from each other to permit flow of a heat exchange second fluid over said fins and between said spaced portions for substantially unrestricted flow of said second fluid and said fins being essentially serpentine in cross section with the fins of the two sets each having a plurality of linearly successive apexes adjacent to but spaced from corresponding apexes of the other set to provide for said second fluid circulation; and a metallurgical bond integrally joining said fins to the respective said tubes so as to make each set of fins and its respective tube an integral, efficient, and metallurgically continuous heat transferring unit.

2. the heat exchanger of claim 1 wherein said metallurgical bond comprises brazed joints interconnecting the fins to the respective tubes.

3. The heat exchanger of claim 1 wherein said metallurgical bond comprises soldered joints interconnecting the fins to the respective tubes.

4. The heat exchanger of claim 1 wherein said metallurgical bond comprises welded joints interconnecting the fins to the respective tubes.

5. The heat exchanger of claim 1 wherein said tubes are each of generally oval cross section with essentially parallel sides, and said fins being attached to said parallel sides.

6. The heat exchanger of claim 1 wherein there are provided forced flow means for forcing said second fluid over and between said fins.

* * * * *